US005104053A

United States Patent [19]

Bradshaw

[11] Patent Number: 5,104,053

[45] Date of Patent: Apr. 14, 1992

[54] STRAND WINDING MACHINE

[76] Inventor: John A. Bradshaw, 99 Seaside Ave., Key Largo, Fla. 33037

[21] Appl. No.: 583,952

[22] Filed: Sep. 17, 1990

[51] Int. Cl.[5] ..... B65H 54/14; B65H 55/02

[52] U.S. Cl. ..... 242/27; 242/31; 242/35; 242/159; 242/175

[58] Field of Search ..... 242/27, 27.1, 28, 29, 242/30, 31, 32, 34, 35, 18 R, 47, 159, 174, 175; 57/67, 71

[56] References Cited

U.S. PATENT DOCUMENTS

| | | | |
|---|---|---|---|
| 674,078 | 5/1901 | Cree, Jr. | 242/31 |
| 674,114 | 5/1901 | Cree, Sr. | 242/31 |
| 777,101 | 12/1904 | Hooper | 242/27 |
| 976,698 | 11/1910 | Ryon | 242/27 |
| 2,035,268 | 3/1936 | Johnson | 242/27 |
| 2,209,208 | 7/1940 | Reiners et al. | 242/32 |
| 2,369,606 | 2/1945 | Reiners et al. | 242/32 |
| 2,780,418 | 2/1957 | Davis | 242/27 |
| 3,000,581 | 9/1961 | Beecher | 242/27 |
| 3,150,480 | 9/1964 | Ortmans | 57/71 X |
| 3,173,239 | 3/1965 | Ortmans | 57/71 X |
| 3,383,851 | 5/1968 | Hickman | 242/159 X |
| 3,545,192 | 12/1970 | Hickman | 242/159 X |
| 3,782,096 | 1/1974 | Karlson | 242/18 R |
| 3,785,137 | 1/1974 | Karlson | 242/159 X |
| 3,848,405 | 11/1974 | Karlson | 242/18 R X |

FOREIGN PATENT DOCUMENTS

| | | | |
|---|---|---|---|
| 2780 | 1/1971 | Japan | 242/27 |
| 521131 | 5/1940 | United Kingdom | 242/32 |
| 1115624 | 5/1968 | United Kingdom | 242/27 |

*Primary Examiner*—Stanley N. Gilreath
*Attorney, Agent, or Firm*—Malloy, Downey & Malloy

[57] ABSTRACT

An integral winding machine for winding strand onto a cylindrical package having a hollow core extending axially therethrough and a conical shaped end portion. While maintaining the package stationary, the winding machine receives the strand from a supply source and thereafter winds and deposits the strand in a helical path onto the package, resulting in a uniform, coreless, self-supporting cylindrical package of continuous strand material. The resulting package is adapted to be held stationary while the strand is withdrawn therefrom without introducing any additional twist to the strand. During continuous delivery of the strand material from the supply source for deposit onto the conical shaped end portion of the package, portions of the resulting formed cylindrical package may be regularly removed without stopping the winding process. In this manner, an endless number of portions can be formed with each portion being interconnected with the next succeeding portion, wherein exceedingly long, knotless and endless lengths of strand are available for subsequent use.

15 Claims, 5 Drawing Sheets

FIG. 2
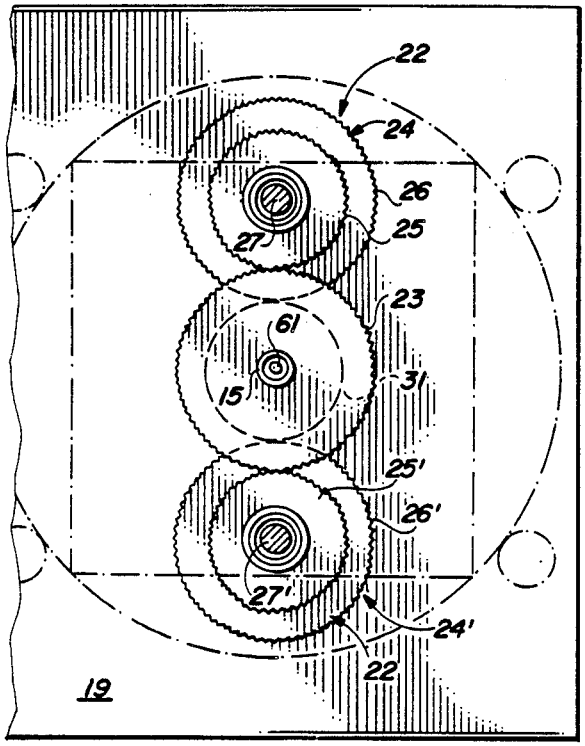
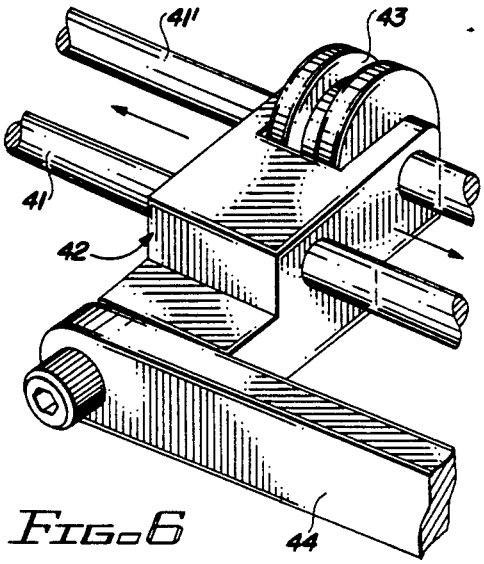
FIG. 6
FIG. 4A
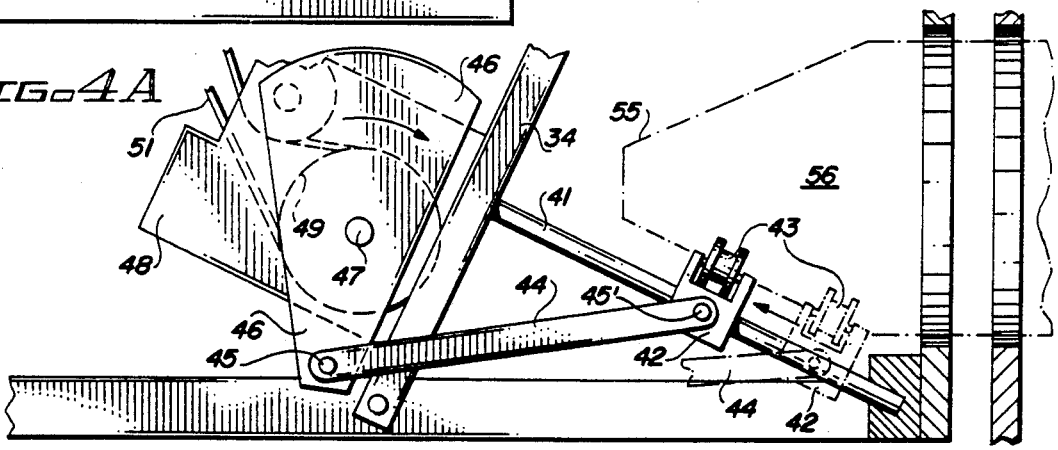
FIG. 4B
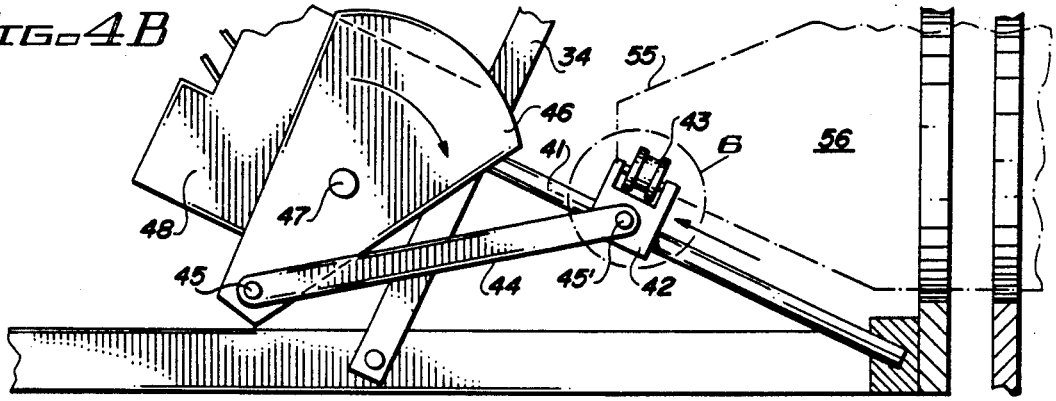

FIG. 7A
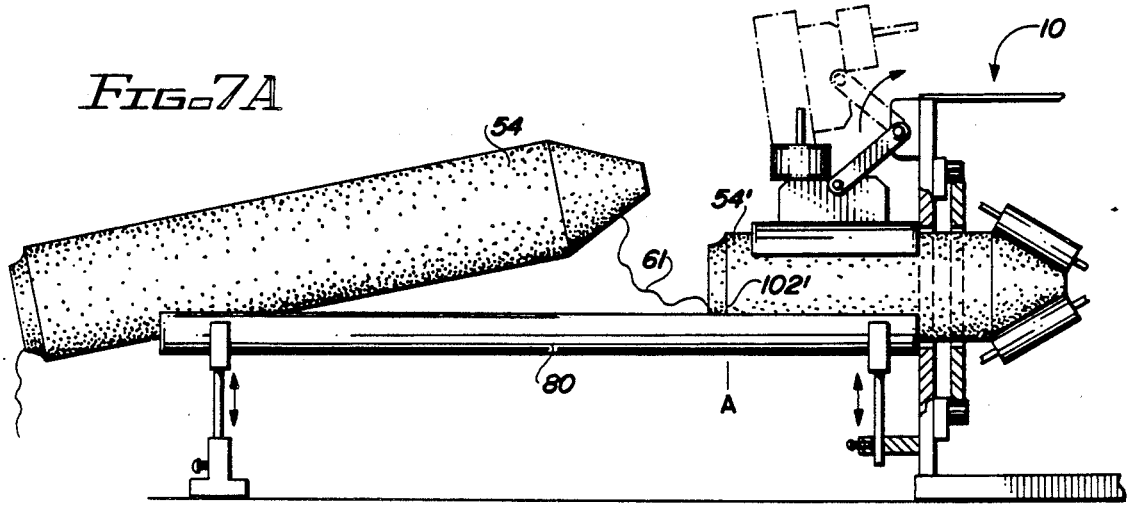
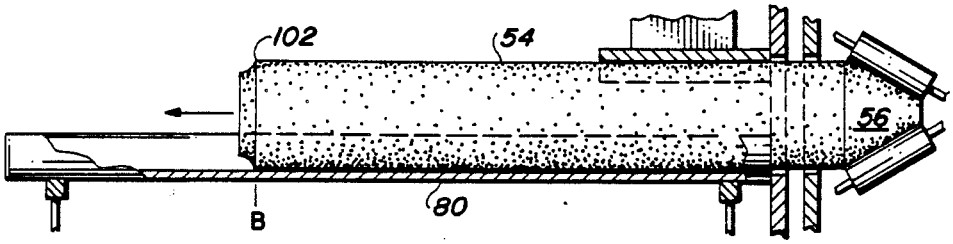
FIG. 7B
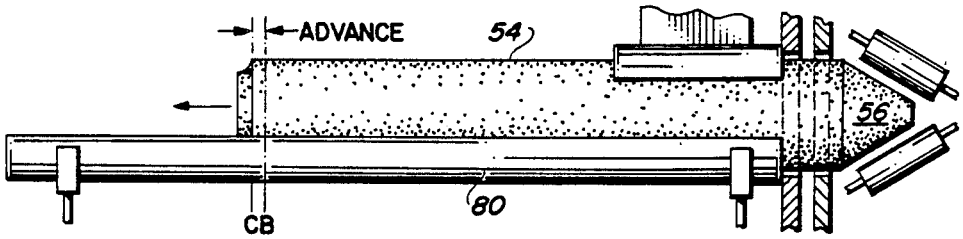
FIG. 7C
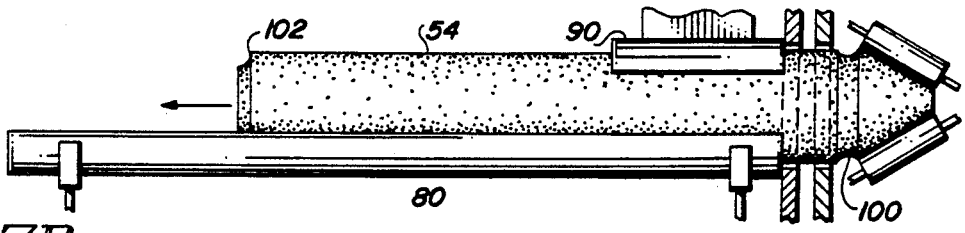
FIG. 7D
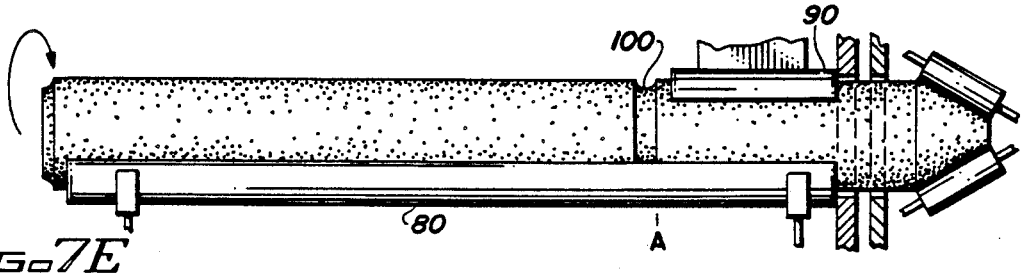
FIG. 7E

STRAND WINDING MACHINE

BACKGROUND OF THE INVENTION

1. Field of the Invention

An integral winding machine for winding strand onto a stationary, cylindrical, self-supporting package wherein the machine transfers the strand of material from a supply source to the package in such a manner that the strand may subsequently be withdrawn from the package with no additional twist being added thereto.

2. Description of the Prior Art

The prior art is crowded with numerous machines designed to wind strand such as yarn, thread, rope, cord and the like into a neat package suitable for shipment within the related industries. Normally, these winding machines receive a single strand of material and wind it about a central core of the package which acts a mounting surface, providing stability and defining the overall shape of the package. These packages, as commonly used in the textile industry, are principally produced by winding or wrapping the strand about the central core by leading the strand onto the core while the core rotates so as to accumulate the strand thereabout. When the strand is required to be removed from the package for its intended use, the strand may be drawn away from the central core in such a manner which causes the package to unroll thereby releasing the strand. Accordingly, during unrolling of the package, the central core is rotated in the opposite direction to that in which it was originally rotated to wind the strand onto the core. This method of strand delivery from the wound package produces no change in twist to the strand as it releases therefrom. However, this method is often found to be unsatisfactory because as the strand is drawn from the package, the central core often overruns resulting in unacceptable variance in the tension in the strand as it is being delivered from the package. Often, the strand on these wound packages is fed through machinery such as those used in the textile industry for weaving the strand into a fabric. Regardless of the type of machinery or the material being used, it is extremely important that the strand is delivered to the machine under a constant speed and tension to avoid overrun of the strand which may lead to kinking and jamming as well as unnecessary stress exerted on the machinery.

To avoid this problem, most methods of strand delivery in the present art are accomplished by maintaining the package in a stationary position while withdrawing the strand off the end therefrom for its intended use. However, since the strand is normally wound onto the package by rotating the central core, withdrawing the strand off the end while maintaining the package stationary results in an additional twist being added to the strand. It is extremely important that strand composed of multi-filaments, such as spun yarns and the like, possess only a good binding twist to contain the yarn firmly together. Any additional twist added thereto during delivery from the package often results in unacceptable kinking of the strand which leads to jamming of the machinery.

Accordingly, there is a need in the textile industry, as well as other related industries requiring the use of wound strand material, for a strand winding machine adapted to transfer strands of material from a supply source to a stationary, coreless, self-supporting cylindrical package wherein the strand can be withdrawn from the stationary package without introducing any additional twist thereto. Additionally, there is a need for a strand winding machine which is adapted to continuously wind strand onto a stationary, coreless, self-supporting package wherein portions of the formed package may be regularly removed without stopping the machine or the winding process, with each removed portion being interconnected with the next succeeding portion. Further, there is a need in the present art for a strand winding machine adapted to form a plurality of interconnected coreless cylindrical packages or portions thereof such that exceedingly long, knotless and endless lengths of strand are available for a required use.

SUMMARY OF THE INVENTION

The present invention is directed towards an integral winding machine adapted to deliver at least a single strand of material from a supply source to a stationary, cylindrical coreless package wherein the winding machine deposits the strand about a conical shaped end of the package leaving a hollow core extending axially therethrough. An integral part of the invention is the wound package of strand which consists of a self contained cylindrical unit having a conical shaped first end portion and a concave second end portion with a hollow core extending axially therethrough. Additionally, the present invention includes the process of winding the strand onto the stationary package while delivering the strand in a helical path and depositing the strand about the conical shaped end portion of the package while constantly moving the package outward in a linear direction away from the machine as the strand builds up about the conical end portion.

The winding machine of the present invention is adapted to be placed between the strand supply source and the package and includes a main support housing having two oppositely disposed vertical end walls and a vertical interior wall separating a drive compartment from a main winding compartment. A main drive shaft is rotatably mounted to and extends through the vertical walls of the drive compartment wherein an outboard end of the drive shaft is drivingly engaged with an electric motor within the drive compartment. An inboard end of the drive shaft extends into the main winding compartment and includes a differential transmission unit mounted to the main drive shaft in close, spaced relation from the inboard end within the main winding compartment. The differential transmission unit includes a main drive gear mounted to the drive shaft and adapted to rotate therewith. Intermeshing with and adapted to rotate about the main drive gear are a pair of planetary gear units each having a pinion gear intermeshing with the main drive gear. The planetary gear units are mounted on gear shafts extending from and rotatably mounted within an end bracket structure. Fixed to the pinion gears in each of the planetary gear units is a somewhat larger second gear positioned and disposed to intermesh with a fixed sun gear mounted to an inner surface of the vertical interior wall. Accordingly, as the main drive shaft rotates, the rotational movement is transmitted to the end bracket structure through the planetary gear units causing the bracket structure to rotate at a somewhat slower speed than the main drive shaft. Attached to the end bracket and extending across the length of the winding compartment is a rotatable cage assembly adapted to be rotated about the center line axis of the main drive shaft.

Mounted within the cage assembly, there is a traverse motion assembly adapted to deliver the strand to the conical end portion of the package in a helical path accomplished through both reciprocating linear motion and circular motion about the package. The traverse motion means includes a reciprocating strand delivering guide which is adapted to move along guide bars in a reciprocating, linear motion while guiding the strand out for deposit on the package as the entire cage assembly rotates about the conical end portion.

The cage assembly includes an end ring rotatably mounted within the structural housing to one of the vertical end walls, the end ring being adapted to rotate about the cylindrical body of the package.

The rotating cage assembly further includes a package guide means mounted between a slant mounting plate within the cage assembly and the end ring. The package guide means includes three slant rollers positioned so as to engage the outer surface of the conical end portion of the package and rotate thereabout, thereby maintaining the conical shape while additionally forcing the package outward in a linear motion from the support housing as the deposited material builds up about the conical end portion. Additionally, the package guide means includes a short stub shaft adapted to support the end of the conical end portion while extending partially within the hollow core of the package. The short stub shaft includes a series of sleeve bushings disposed within the hollow end of the conical end portion. The sleeve bushings are adapted to reduce drag between the non-rotating package hollow core and the rotating stub shaft. Additionally, the sleeve bushings are adapted to slide along the interior length of the hollow core as the package is slowly moved outward from the winding machine as the strand builds up about the conical end portion.

Continuous winding of the strand results in a uniform, self-supporting, cylindrical package which is extremely functional for its intended use. Specifically, the resulting formed package is adapted to be held stationary while the strand is withdrawn therefrom without adding any new or additional twists thereto.

An additional important feature of the present invention is the capability of forming a plurality of interconnected packages composed of an extremely long length of endless and knotless strand.

The invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which:

FIG. 2 is a side elevation view taken along line 2—2 of FIG. 1.

FIG. 4A is an isolated side view of a traverse motion unit of the present invention.

FIG. 4B is a second isolated side view of the traverse motion unit of FIG. 4A shown at a different position during the depositing of strand onto a package.

FIG. 6 is an isolated view shown in perspective illustrating a slide block and guide roller of the present invention.

FIG. 7A is a side view illustrating a package of wound strand being separated from a next succeeding, interconnected package.

FIG. 7B is a side view taken in sequence of the wound package being continuously formed as it exits from the winding machine.

FIG. 7C is a side view taken in sequence illustrating movement of the wound package in order to begin formation of a deep groove at a conical end portion thereof.

FIG. 7D is a side view taken in sequence illustrating the deep groove formed in the conical end portion.

FIG. 7E is a side view taken in sequence illustrating the package portion ready for separation by rotating and withdrawing as a next succeeding package is formed.

Like reference numerals refer to like parts throughout the several views of the drawings.

DETAILED DESCRIPTION OF THE PREFERRED EMBODIMENT

As shown in FIGS. 1 through 7, the present invention is directed towards an integral winding machine for winding strand onto a cylindrical, self-supporting package having a hollow core extending axially therethrough and a conical shaped end portion. Additionally, the present invention is directed towards the resulting formed self-supporting cylindrical package, which in its intended use is adapted to be held stationary while the strand is withdrawn therefrom without adding any additional twists to the strand. The present invention is also directed to the process for winding the strand into a self-supporting, cylindrical package.

Figure 1:
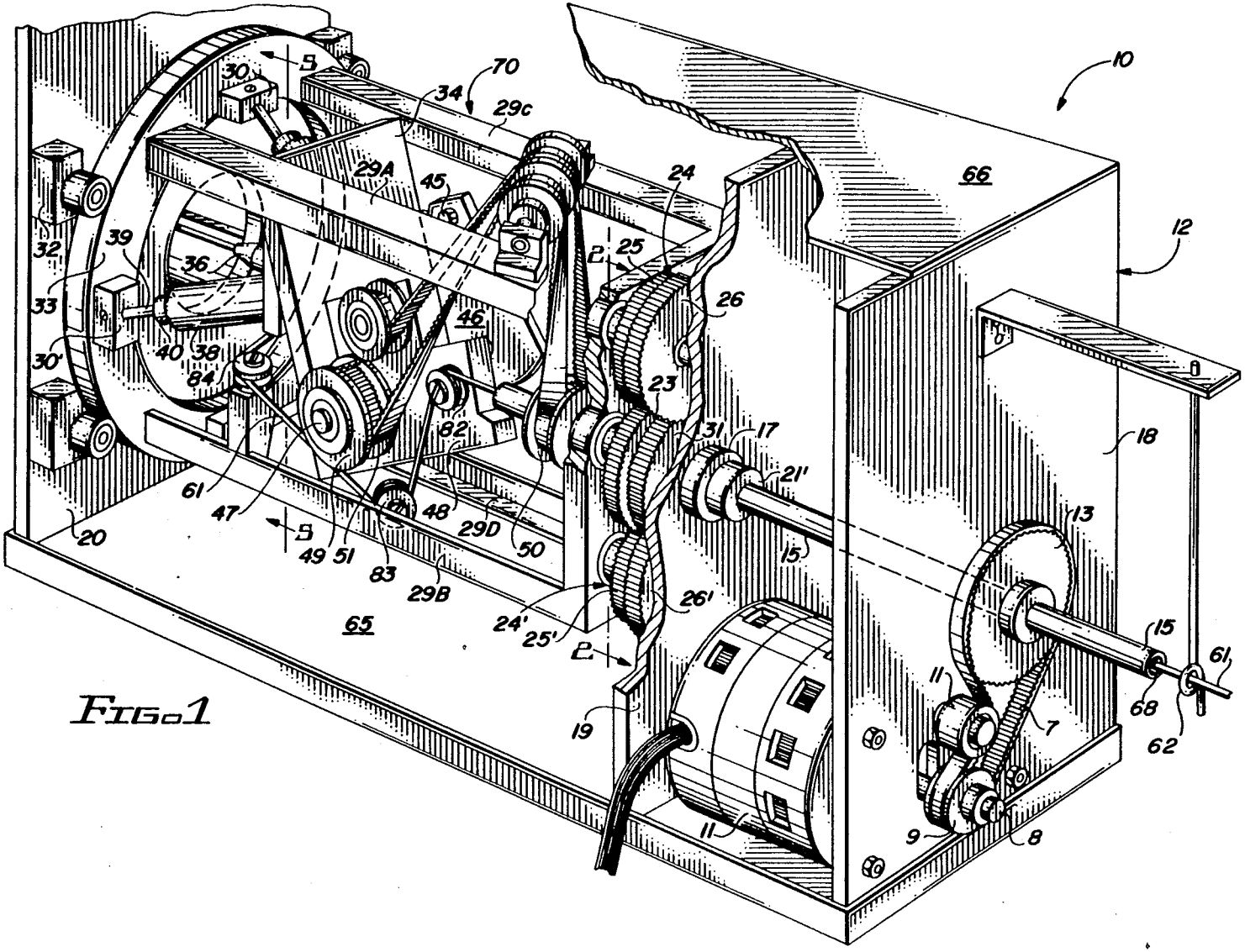
FIG. 1 is a perspective view of a preferred embodiment of the winding machine of the present invention.
Figure 1A:
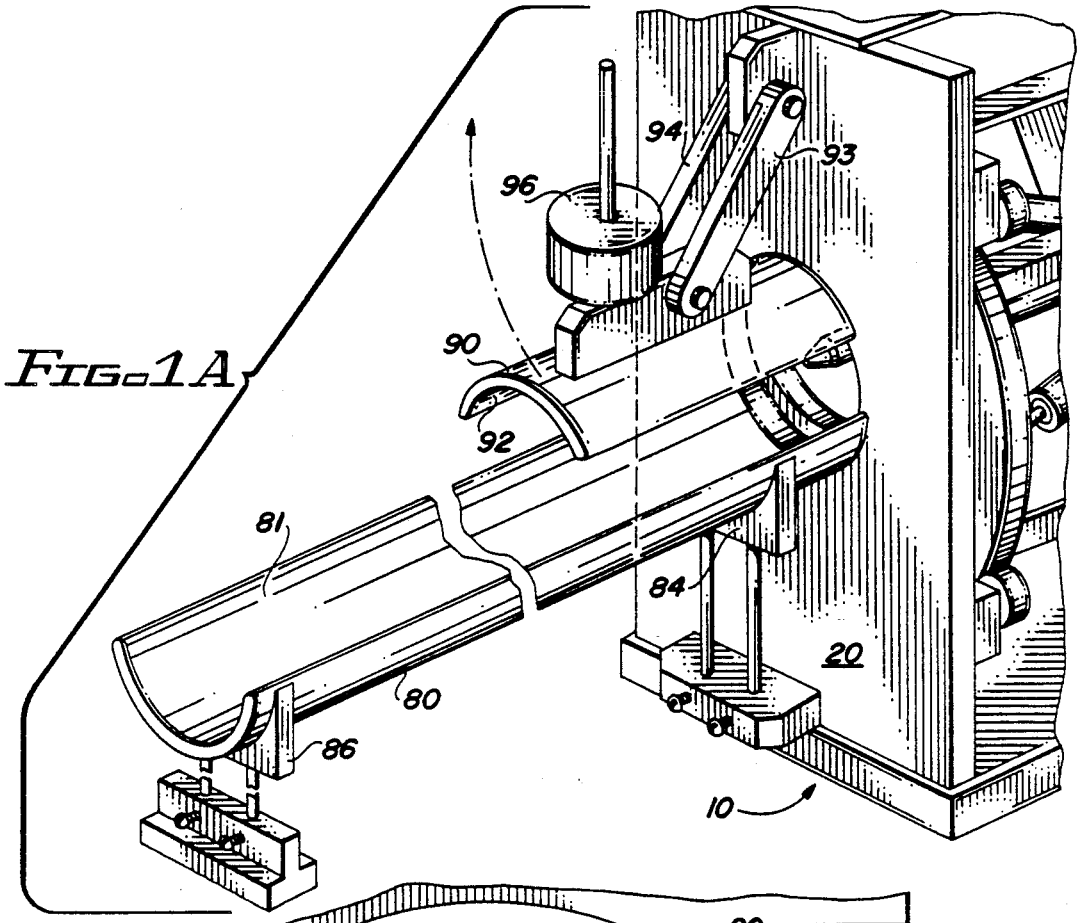
FIG. 1A is a partial cutaway view shown in perspective of a support trough and package stabilizing means mounted at the end of the winding machine.
Figure 5:
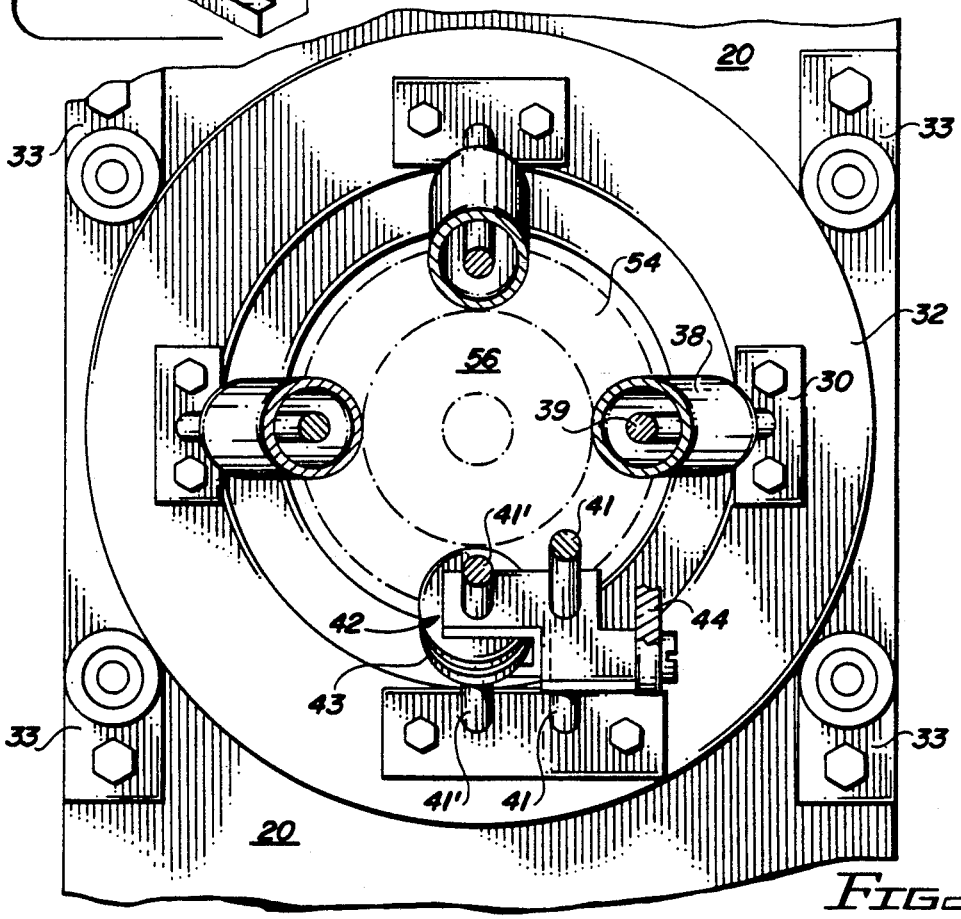
FIG. 5 is a side view in partial cross-section taken along line 5—5 of FIG. 1.
Figure 3:
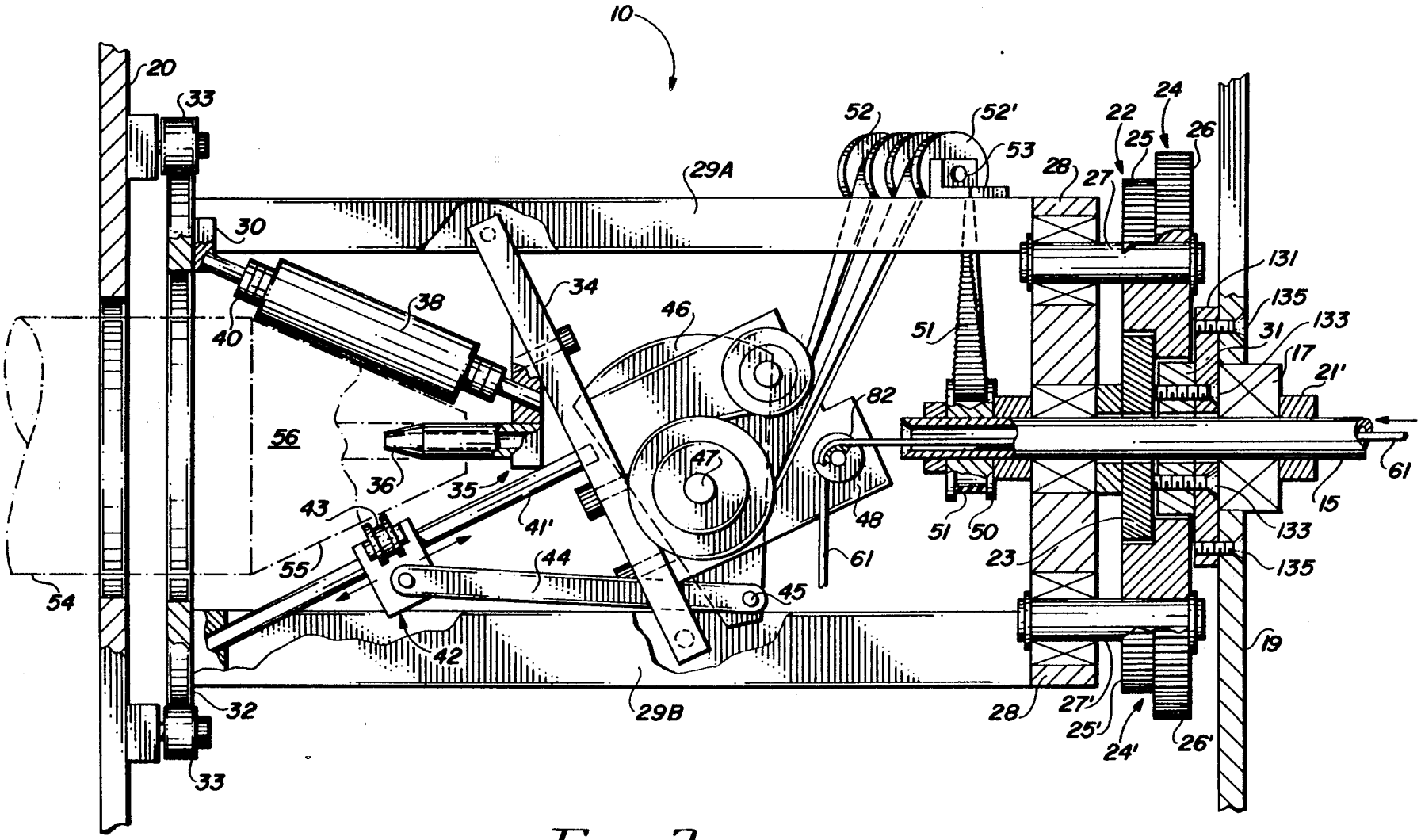
FIG. 3 is a front plan view of the winding machine of FIG. 1.

With reference to FIGS. 1 and 3, an integral part of the present invention is the winding machine generally indicated as 10 which includes a support housing structure 12 having a plurality of vertical support walls including two oppositely disposed vertical end walls 18 and 20 and a vertical interior wall 19. Supported on opposite ends of the vertical walls, there is a top cover plate 66 and a bottom longitudinal support structure 65.

A drive assembly housing is defined between a first vertical end wall 18 and the vertical interior wall 19. Mounted within the drive housing, there is an electric motor 11 having a rotating shaft 8 extending therefrom and out through the vertical end wall 18 having a pulley 9 mounted to an outboard end zone thereof. A drive belt 7 is fitted about pulley 9 and a drive gear 13 in driving engagement therewith, wherein rotation of the shaft 8 and attached pulley 9 serves to rotate drive gear 13. A main drive shaft 15 is rotatably mounted to and extends between the vertical end wall 18 and the vertical interior wall 19 being rotatably supported by a bearing unit 17 mounted to the vertical end wall and the vertical interior wall respectively. A shaft collar 21 mounted to the main drive shaft 15 adjacent to the support bearing unit 17 preventing longitudinal movement of the drive shaft 15 therethrough.

A differential transmission unit 22 is mounted near the inboard end of the main drive shaft 15 and includes a drive gear 23 mounted to the main drive shaft 15 and adapted to rotate therewith. A pair of planetary gear units 24 and 24' are disposed in intermeshing engagement with the drive gear 23 so as to revolve about the drive gear 23 upon rotation of the main drive shaft 15. The planetary gear units 24 and 24' each include a pinion gear 25 and 25' and an adjacent second larger gear 26 and 26' fixedly connected to the pinion gear 25 and 25', respectively. Each planetary gear unit 24 and 24' is rotatably mounted and supported on a planetary gear shaft 27 and 27', respectively, such that the pinion gears 25 and 25' intermesh with the drive gear 23 so as to revolve thereabout while the second larger gears 26 and 26' are disposed in intermeshing engagement with a fixed sun gear 31. The sun gear 31 is fixedly attached to a spacer plate 131 by conventional countersunct screws 133. The spacer plate 131 is in turn fixedly mounted to the interior vertical wall 19 with countersunct flush head screws 135.

The planetary gear shafts 27 and 27' are each rotatably mounted within an end bracket 28 which is adapted to rotate about the main drive shaft 15 along a common longitudinal axis. The differing gear ratios in the differential transmission units causes the end bracket to rotate at a slower speed than the main drive shaft 15. An end ring 32 is mounted at an opposite end of the support housing adjacent to the second vertical end wall 20 on an inner side thereof, being rotatably supported within a plurality of ball bearing guide units 33. Connected to and extending longitudinally between the end bracket 28 and the end ring 32 are four longitudinal support bars 29A, 29B,.29C and 29D extending substantially across the length of the main winding compartment and defining a rotating cage assembly 70. Accordingly, the entire cage assembly is adapted to rotate about the same axis as the main drive shaft 15 upon driven rotation thereof. Connecting between upper longitudinal support bars 29A and 29C and lower longitudinal support bars 29B and 29D, a slant plate 34 is mounted so as to extend at an angled orientation from the vertical axis. A vertical mounting plate 35 is connected thereto and extends vertically from the slant mounting plate 34 on an under side thereof. A short stub shaft 36 is mounted to the vertical mounting plate 35 and extends outwardly along the drive shaft centerline being positioned and disposed to support an end 55 of the conical end portion 56 of the strand package 54. The short stub shaft 36 includes a series of sleeve bushings 37, 37' rotatably fitted thereabout so as to be disposed within the hollow end 55 of the conical end portion 56. The sleeve bushings are adapted to slide along the interior length of the hollow core of the end 55 as the package is slowly advanced outwardly from the winding machine 10.

The vertical mounting plate 35 also secures the ends of three slant roller shafts 39 connected to and extending between the vertical mounting plate 35 and the end ring 32 where they are fastened to brackets as at 30 and 30'. Each of the slant roller shafts 39 include a roller 38 rotatably mounted thereto, the slant rollers 38 being positioned and disposed to engage along the outer surface of the conical end portion 56 of the package 54 so as to rotate thereabout while maintaining the overall conical configuration of the end portion 56. The slant rollers 38 also act to apply a force on the package 54 at the conical end portion 56 as the strand of material builds up thereabout. Accordingly, the force applied to the end portion 56 by the slant rollers 38 rotating thereabout forces the package 54 to move outward axially along the main drive shaft centerline.

A traverse motion unit is mounted within the cage assembly 70 and includes a slide block 42 slidably mounted on slide shafts 41 and 41' extending in parallel relation between the slant mounting plate 34 and the end ring 32. A guide roller 43 is mounted within the slide block 42 and is specifically adapted to guide the strand out therefrom for placement out onto the conical end portion 56 of the package 54 upon rotation of the cage assembly 70. The slide block 42 is interconnected to a rotating plate 46 by a lever arm 44 pivotally connected at opposite ends to both the slide block 42 and the rotating plate 46 at 45 and 45'. The rotating plate 46 is, in turn, rotatably mounted to a transverse auxiliary shaft 47 extending outwardly on opposite sides of a bearing block 48 which is mounted to an inner side of the slant mounting plate 34. Connected at the opposite end of the transverse auxiliary shaft 47 is a toothed pulley 49 driven from toothed pulley 50 on the inboard end of the drive shaft 15. A pair of idler pulleys 52 and 52' are positioned on shaft 53 being bracketed to bars 29A and 29C, respectively. The idler pulleys are specifically positioned and oriented so as to guide a toothed belt 51 between the first pulley 49 and the second pulley 50. Accordingly, rotation of the main drive shaft 15 serves to rotate the pulleys 50 and 49 via the toothed belt 51 thereby rotating the transverse auxiliary shaft 47 and in turn rotating plate 46. Rotation of the plate 46 causes the lever arm to move the slide block 42 along the slide shafts 41 and 41' in a reciprocating motion.

In operation, the strand 61 passes through a pigtail guide 62 extending on an exterior portion of the support housing 12 and positioned so as to guide the strand 61 through the hollow axial bore 68 extending through the entire length of the main drive shaft 15. The strand 61 is fed around a series of guide pulleys as at 82, 83 and 84 directing the strand about the cage assembly so as not to entangle with other moving parts and leading the strand to the guide roller 43 mounted within the slide block 42. Accordingly, as the main drive shaft rotates the cage assembly 70, the strand 61 is guided by guide roller 43 and deposited about the conical end portion 56 of the package 54 while being delivered in a helical path due to both the linear movement of the slide block 42 and the rotational movement of the entire cage assembly 70. The helical path of the strand is important in that it maintains the conical shape of the end portion 56 allowing a self-supported cylindrical package to be formed of any desired length.

A support trough 80 is positioned at the end 20 of the winding machine 10 being positioned and disposed so as to supportably receive a length of the wound package as it continuously exits from the winding machine. The support trough includes an upper supporting surface 81 specifically configured so as to conform with and support the outer cylindrical surface of the wound package 54 as it exits from the winding machine 10. In the preferred embodiment, the support trough is held in position adjacent to an outboard portion of the side wall 20 by a pair of brackets 84 and 86 positioned at opposite ends of the support trough 80.

Additionally, a stabilizing plate 90 is pivotally mounted to an upper portion of the outboard side of the end wall 20, being positionable between a raised position and a lowered stabilizing position on an upper cylindrical surface of the package 54. The stabilizing plate 90 includes an inner stabilizing surface 92 formed and configured to conform with the outer cylindrical surface of an upper portion of the package 54. The stabilizing plate 90 pivots on a pair of pivotally attached links 93 and 94 extending between and pivotally attached at opposite ends to the stabilizing plate 90 and an outboard upper portion of the end wall 20. In this manner, the stabilizing plate 90 is adapted to float freely on the upper cylindrical surface of the package. A weight 96 supported on a top portion of the stabilizing plate 90 employs a sufficient downward force so as to allow longitudinal sliding movement of the package 54 along the support trough 80 while effectively preventing rotation of the package 54 within the trough 80. With reference to FIGS. 7A through 7E, there is seen a sequence of stages illustrating various stages of formation and movement of the cylindrical package 54 as it exits from the winding machine 10 and along the support trough 80. FIGS. 7A through 7E illustrate the process of forming separate, interconnected wound packages of predetermined length best suited for transport or storage. Referring to FIGS. 7A and 7E, there is seen two cylindrical packages 54 and 54' exiting from the winding machine 10 with a deep grove 100 formed between them. This deep groove 100 allows the first package 54 to be doffed off or removed from the next succeeding package 54' by simply rotating the first package 54 relative to the next succeeding package 54' and withdrawing the first package 54 away so as to separate the two packages leaving the continuous strand 61 connecting therebetween. Rotation and movement of the first package 54 to remove it from the next succeeding package 54' can be achieved manually by grasping the first package 54 and quickly twisting or rotating it and pulling away so as to effectively separate the first package 54 from the second package 54' at the deep groove 100. Alternatively, a mechanical means could be structured to effectively doff off the packages 54 as they move along the support trough 80.

The length of the packages 54 and 54' is determined by a series of bench marks located at predetermined distances from the winding machine 10. Referring to FIG. 7B, as an end 102 of the first cylindrical package 54 reaches a predetermined bench mark labeled as B along the length of the support trough 80, the package is moved rapidly a relatively short distance, as indicated in FIG. 7C, along the length of the support trough 80. In this manner, the end 102 of the package 54 moves from bench mark B to bench mark C as strand is continuously wound on the conical end portion 56 of the package. The rapid movement between bench marks B and C causes a deep groove 100 to be formed on the conical end portion 56 as shown in FIG. 7D. With normal winding operation maintained, the cylindrical package continues to be formed as the end 102 moves along the length of the support trough 80. When the deep groove 100 reaches a bench mark labeled A in FIG. 7E along the support trough 80, the first cylindrical package 54 can be removed by rotating and withdrawing away thereby forming a new end 102' on the next succeeding package 54' which will then continue to move along the support trough until it reaches the bench mark B and the process is continued in this manner as individual, yet interconnected self-supported cylindrical packages are formed from a continuous length of strand. Accordingly, these interconnected packages can be conveniently stacked or packaged for shipment.

While the instant invention has been shown and described in what is considered to be a practical and preferred embodiment, it is recognized that departures may be made within the spirit and scope of this invention which is therefore not to be limited except as set forth in the claims hereinafter and within the doctrine of equivalents.

Now that the invention has been described,

What is claimed is:

1. For use in winding at least a single strand of material to form a uniform cylindrical package having a hollow axial core extending therethrough and a conical shaped end portion, a strand winding apparatus adapted to transfer the strand between a strand supply source and the cylindrical package, said apparatus comprising:

a support housing including a surrounding support frame structure, a main drive shaft extending at least partially through and supported within said support housing, said main drive shaft including an outboard end drivingly interconnected to said main drive assembly and an inboard end disposed within a main compartment of said support housing, a main drive assembly mounted within said support housing and drivingly interconnected to said main drive shaft, differential transmission means drivingly interconnected with said inboard end of said main drive shaft defining a power takeoff unit, a cage assembly attached to said differential transmission means, said differential transmission means being structured and disposed to rotate said cage assembly at a reduced speed relative to the rotational speed of said main drive shaft, traverse motion means mounted to said cage assembly and drivingly interconnected with said inboard end of said main drive shaft, said traverse motion means including a reciprocating strand delivering guide adapted to rotate about the conical end portion of the package while maintaining the package stationary so as to deposit the strand thereon in such a manner so that the strand may be later withdrawn from the stationary package without any twist being added thereto, guide means mounted within said cage assembly positioned and disposed in supporting, guiding engagement with the conical end portion of the package and adapted to maintain the conical shape of the conical end portion and simultaneously force the package axially outward from within the support housing upon build up of the strand material being deposited on the conical end portion of the package, and whereby continued operation of the strand winding apparatus results in continuous, uninterrupted formation of the uniform cylindrical package.

2. An apparatus as in claim 1 further comprising a support trough positioned at an end of said support housing and being structured and configured to support the cylindrical package upon forced axial outward movement from within the support housing.

3. An apparatus as in claim 1 further comprising stabilizing means mounted adjacent to said end of said support housing above said support trough, said stabilizing means being structured and disposed so as to engage the cylindrical package in such a manner as to allow axial outward movement of the package from within said support housing while effectively preventing rotation of the cylindrical package as the strand is continuously deposited on the conical end portion.

4. An apparatus as in claim 3 wherein said differential transmission means includes a plurality of intermeshing gears including a main drive gear mounted to said drive shaft, said main drive gear intermeshing in driving relation to a pair of pinion gear units disposed about said main drive gear, each of said pinion gear units being rotatably mounted to one of two pinion gear shafts attached to and extending from an end bracket, said pinion gear units being positioned and disposed to orbit about the periphery of said main drive gear upon rotation of said drive shaft.

5. An apparatus as in claim 4 wherein said pinion gear units each include a first pinion gear disposed in intermeshing engagement with said drive gear and a larger second pinion gear fixedly attached to said first pinion gear, said second pinion gear on each of said pinion gear units being disposed in intermeshing engagement with a fixed sun gear mounted to a vertical interior wall in surrounding relation to said main drive shaft.

6. An apparatus as in claim 5 wherein said cage assembly includes a slant mounting plate mounted at an angle from vertical within said cage assembly and connecting at opposite ends to upper longitudinal supports and lower longitudinal supports.

7. An apparatus as in claim 6 wherein said traverse motion means includes a bearing block mounted to an inward side of said slant mounting plate having a transverse shaft rotatably supported therein, said transverse shaft including a first pulley attached to one end thereof, said first pulley structured and disposed to be rotatably driven by a toothed power takeoff belt drivably engaged about said first pulley and a second pulley mounted to said inboard end of said drive shaft.

8. An apparatus as in claim 7 wherein said transverse shaft includes a rotating plate attached to an opposite end thereof, said rotating plate being interconnected to a reciprocating strand delivering guide by a lever arm, wherein forced rotation of said rotating plate serves to move said strand delivering guide in a linear, reciprocating motion.

9. An apparatus as in claim 8 wherein said reciprocating strand delivering guide includes a slide block slidably mounted on a pair of parallel slide bars connected to and extending between said slant mounting plate and a rotating end ring.

10. An apparatus as in claim 9 wherein said slide block includes a guide roller rotatably mounted therein structured and configured to guide the strand of material therethrough for deposit onto the conical end portion of the package.

11. An apparatus as in claim 10 wherein said reciprocating slide block, including said guide roller, is positioned and disposed so as to move both linearly and rotationally about the surface of the conical end portion in close, spaced relation thereto so as to deliver the strand of material to the conical end portion in a helical path.

12. An apparatus as in claim 11 wherein said guide means includes a plurality of equi-spaced slant rollers each individually rotatably mounted on a plurality of equi-spaced roller shafts extending between and connecting to said cage assembly and a vertical mounting plate attached to said slant mounting plate.

13. An apparatus as in claim 12 wherein said slant rollers are structured and disposed to maintain the conical shape of the conical end portion, said slant rollers engaging with and rotating about an outer surface of the conical end portion of the package so as to iron out and and maintain a smooth conical shape of the outer surface while simultaneously forcing the package axially outwardly from within said support housing upon continued build up of the strand of material on the conical end portion of the package.

14. An apparatus as in claim 13 wherein said package guide means further includes a short stub shaft mounted to and extending from said vertical support plate, said short stub shaft being positioned and disposed in axial alignment with the drive shaft and adapted to be slidably positioned within the end of the hollow axial core of the package thereby defining a winding mandrel providing support and stability to the conical end portion and preventing collapsing due to winding pressure.

15. An apparatus as in claim 14 wherein said short stub shaft includes a series of sleeve bushings rotatably mounted thereabout, said sleeve bushings disposed within the hollow end of the conical end portion being adapted to reduce drag between the non-rotating package hollow core and said rotating stub shaft.

* * * * *